US012077269B2

(12) United States Patent
Latham

(10) Patent No.: US 12,077,269 B2
(45) Date of Patent: Sep. 3, 2024

(54) HYBRID UNMANNED UNDERWATER VEHICLE

(71) Applicant: Tridentis Advanced Marine Vehicles, LLC, Kailua Kona, HI (US)

(72) Inventor: William Latham, Stafford, VA (US)

(73) Assignee: Tridentis Advanced Marine Vehicles, LLC, Kailua Kona, HI (US)

( * ) Notice: Subject to any disclaimer, the term of this patent is extended or adjusted under 35 U.S.C. 154(b) by 282 days.

(21) Appl. No.: 17/445,058

(22) Filed: Aug. 13, 2021

(65) Prior Publication Data

US 2023/0050716 A1 Feb. 16, 2023

(51) Int. Cl.

| | |
|---|---|
| ***B63G 8/08*** | (2006.01) |
| ***B63G 8/00*** | (2006.01) |
| ***B63G 8/04*** | (2006.01) |
| ***B63H 11/02*** | (2006.01) |

(52) U.S. Cl.

CPC ..... *B63G 8/001* (2013.01); *B63G 8/04* (2013.01); *B63G 8/08* (2013.01); *B63H 11/02* (2013.01); *B63G 2008/002* (2013.01)

(58) Field of Classification Search

CPC . B63G 8/001; B63G 8/04; B63G 8/08; B63G 2008/002; B63G 8/16; B63H 11/02

See application file for complete search history.

(56) References Cited

U.S. PATENT DOCUMENTS

| | | | |
|---|---|---|---|
| 7,533,625 | B2 | 5/2009 | Lambertus et al. |
| 8,098,545 | B2 | 1/2012 | Rhodes et al. |
| 8,731,751 | B2 | 5/2014 | Simon, Jr. et al. |
| 9,061,740 | B2 | 6/2015 | Henriksen |
| 2004/0092176 | A1 | 5/2004 | Allen |
| 2009/0204280 | A1 | 8/2009 | Simon, Jr. et al. |
| 2010/0212573 | A1 | 8/2010 | Hawkes et al. |
| 2012/0055390 | A1 | 3/2012 | Kalwa et al. |
| 2017/0174300 | A1* | 6/2017 | Moreno ..... B25J 9/08 |
| 2021/0300513 | A1* | 9/2021 | Allotta ..... B25J 9/08 |

FOREIGN PATENT DOCUMENTS

| | | | |
|---|---|---|---|
| EP | 2632789 | B1 | 12/2014 |
| ES | 2311424 | B1 | 2/2009 |
| JP | 5038903 | B2 | 10/2012 |
| JP | 5449275 | B2 | 3/2014 |
| KR | 20110004981 | A1 | 1/2011 |
| WO | 2008037349 | A1 | 4/2008 |
| WO | 2009024639 | A1 | 2/2009 |

OTHER PUBLICATIONS

James Carroll, Fusion Hybrid Autonomous Underwater Vehicle to be Highlighted at XPONENTIAL, Vision Systems Design <https://www.vision-systems.com/embedded/article/16750976/fusion-hybrid-autonomous-underwater-vehicle-to-be-highlighted-at-xponential.>, 1 page, Apr. 20, 2017, retrieved on Jul. 16, 2021.

* cited by examiner

*Primary Examiner* — Andrew Polay

(74) *Attorney, Agent, or Firm* — Greer, Burns & Crain, Ltd.

(57) ABSTRACT

An unmanned underwater vehicle having movable thrusters between a first configuration, in which axes of rotation of both the thrusters, when co-planar, are parallel, and a second configuration, in which the axes of rotation of both the thrusters, when co-planar, interest. The thrusters may also rotate about the pylons that attach the thrusters to the body of the unmanned underwater vehicle. Also a method of operating the unmanned underwater vehicle in both configurations.

16 Claims, 6 Drawing Sheets

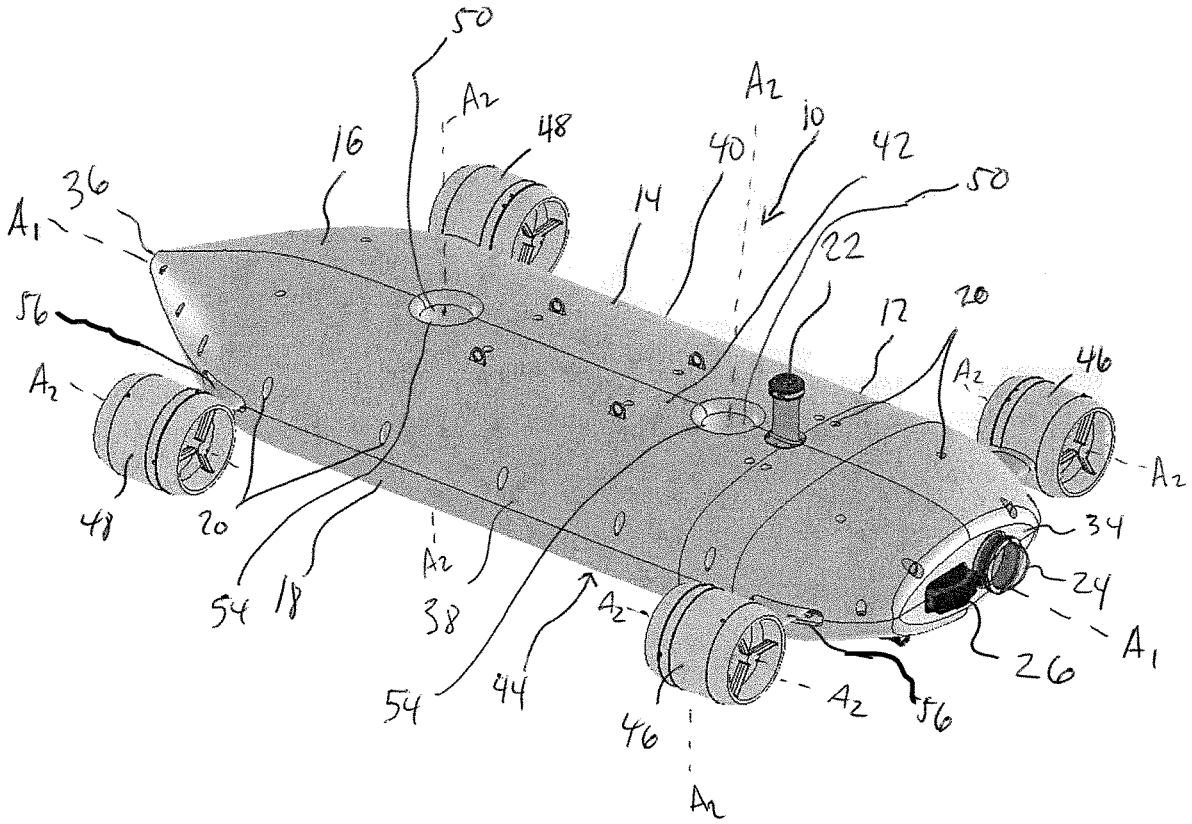
FIGURE 1
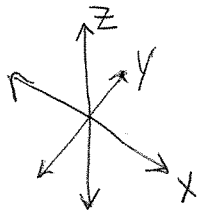

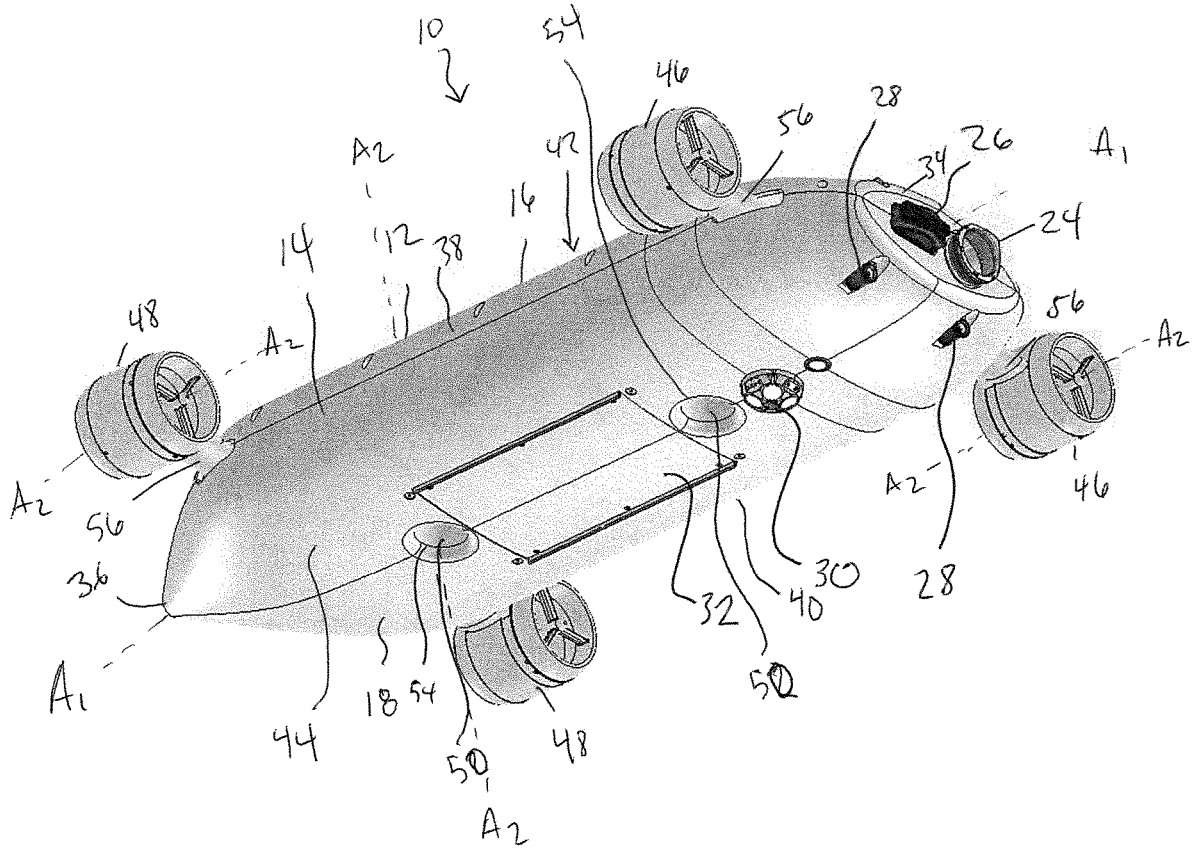
FIGURE 2
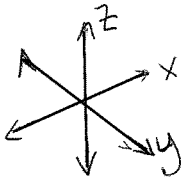

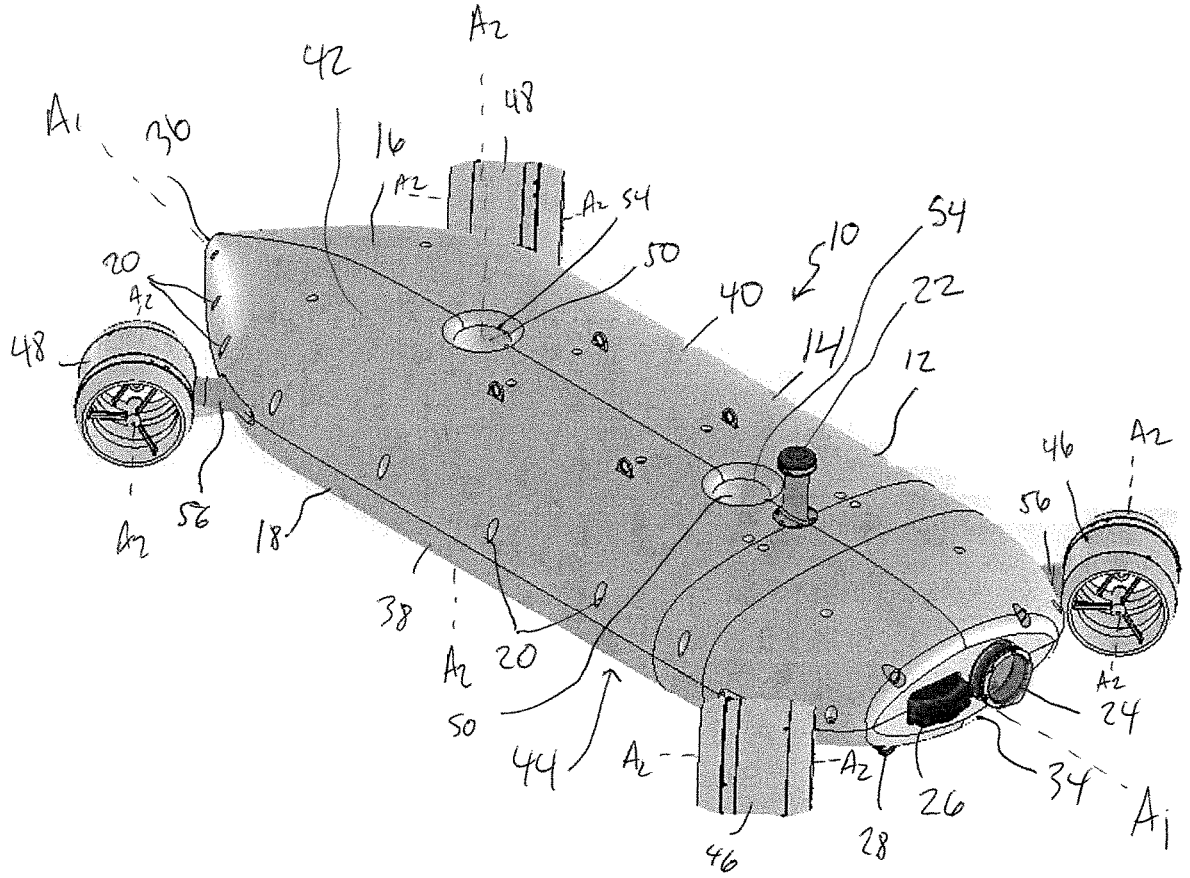
FIGURE 4
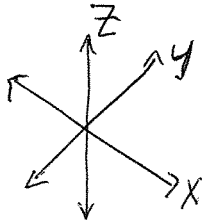

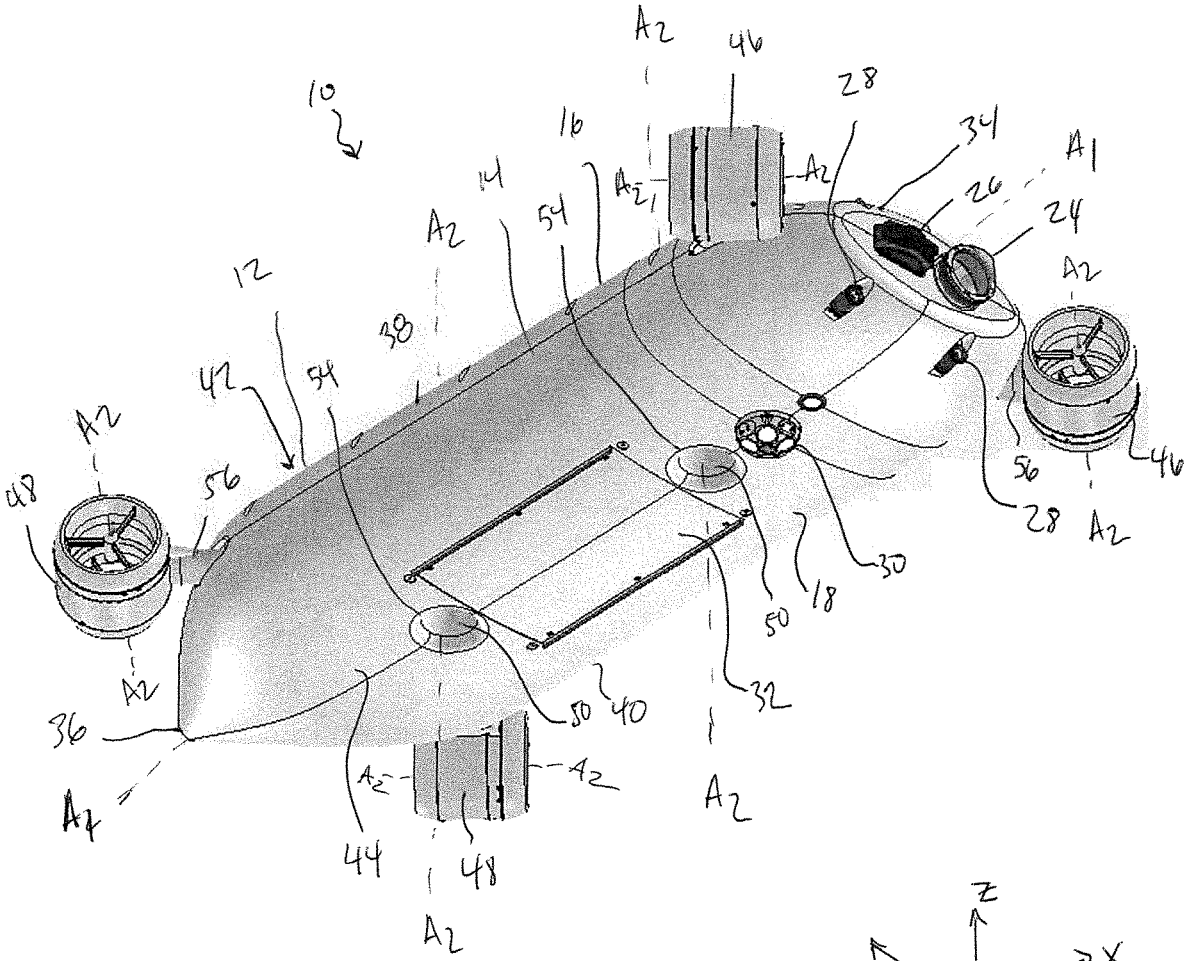
FIGURE 5
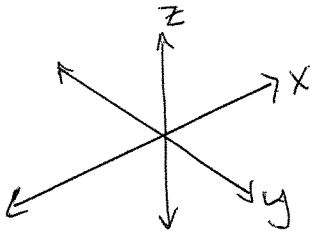

HYBRID UNMANNED UNDERWATER VEHICLE

STATEMENT REGARDING FEDERALLY SPONSORED RESEARCH OR DEVELOPMENT

None.

FIELD OF THE INVENTION

The present invention relates to unmanned underwater vessels, and more specifically, to a hybrid underwater vessel suitable as an autonomous underwater vessel and as a remotely operated underwater vessel.

BACKGROUND OF THE INVENTION

Unmanned underwater vessels (UUVs) encompass vessels which are remotely operated underwater vessel (ROVs) and autonomous underwater vessels (AUVs). The ROVs typically are controlled by a remote operator while AUVs typically operate independent of a remote operator. Both types of UUVs are beneficial for a variety of applications including scientific applications, commercial offshore applications, and military applications.

Typically, ROVs have thrusters that are orientated for more delicate and precise movements for the vessel. Such a configuration is not well suited for long-range movement because the thrusters are not positioned to provide efficient use of energy. In contrast, AUVs typically have thrusters that orientated for long-range movement. Accordingly, the AUVs are not fully suited for the delicate and precise movements that an ROV can perform due to the orientation of the thrusters.

Some UUVs provide different sets of thrusters for each type of movement. Accordingly, such UUVs are a "hybrid" UUV that is capable of both types of movements (i.e., long-range and precise). While presumably effective for their intended purposes, the hybrid UUVs with two different sets of thrusters for different types of movement increases the weight of such hybrid vessels. Thus, this solution increases the weight and thereby increases the energy required for movement of the vessel. Since the UUVs provide their own energy, for example from one or more batteries, this increased energy requirement reduces the time that the UUV may be deployed.

Accordingly, it would be desirable to provide a hybrid UUV which effectively and efficiently allows for both long-range movement of a typical AUV and the precise movements typically provided in an ROV.

SUMMARY OF THE INVENTION

A new unmanned underwater vehicle (UUV) has been invented. The new UUV is a hybrid UUV with thrusters that move between different configurations. In a first configuration the thrusters are configured for efficient long-range movement. In a second configuration, the thrusters are configured for more precise movement.

Accordingly, in an aspect of the present invention, the present invention may be generally characterized as providing an unmanned underwater vehicle with: a hull forming a body with a longitudinal axis of the unmanned underwater vehicle extending between a front and a rear of the body, the longitudinal axis being an X-axis, a Y-axis which extends between opposing sides of the body, and Z-axis which extends between a top and a bottom of the body, the X-, Y-, and Z-axes being orthogonal to each other; a first thruster having an axis of rotation; and, a second thruster having an axis of rotation. The first and second thrusters are selectively movable between a first configuration, in which the axes of rotation of both the first and second thrusters are parallel with the longitudinal axis of the body, and a second configuration, in which the axes of rotation of both the first and second thrusters, when co-planar, intersect.

The first and second thrusters may form a set of thrusters having the same position, on opposing sides, along a length of the body. The unmanned underwater vehicle may further include a third thruster having an axis of rotation and a fourth thruster having an axis of rotation. The third and fourth thrusters may be selectively movable between the first configuration, in which the axes of rotation of both the third and fourth thrusters are parallel with the longitudinal axis of the body, and the second configuration, in which the axes of rotation of both the third and fourth thrusters, when co-planar, intersect. The third and fourth thrusters may form a second set of thrusters having the same position, on opposing sides, along a length of the body. In the first configuration, the axes of the first and third thrusters may be parallel, and the axes of the second and fourth thrusters may be parallel. In the second configuration, the axes of the first and fourth thrusters may be, when co-planar, parallel, and the axes of the second and third thrusters may be, when co-planar, parallel.

The unmanned underwater vehicle may also include a vertical thruster having an axis of rotation parallel with the Z-axis.

In the unmanned underwater vehicle, each thruster may be connected to the body by a pylon. Further, each thruster may be rotatable about an axis of the pylon, the axes of the pylons extending from the body to the respective thruster.

In another aspect, the present invention may be characterized, broadly, as providing an unmanned underwater vehicle having: a hull forming a body with a front, a rear, a first side, a second side opposite the first side, a top, and a bottom; a first set of thrusters positioned proximate the front of the body, the first set of thrusters including a first thruster disposed on the first side and a second thruster disposed on the second side; and, a second set of thrusters positioned proximate the rear of the body, the second set of thrusters including a third thruster disposed on the first side and a fourth thruster disposed on the second side. Each thruster has an axis of rotation. The first set of thrusters is selectively movable between a first configuration, in which the axes of rotation of both the first and third thrusters, when co-planar, are parallel and the axes of rotation of both the second and fourth thrusters, when co-planar, are parallel, and a second configuration, in which the axes of rotation of both the first and second thrusters, when co-planar, intersect.

Each thruster of the unmanned underwater vehicle may be connected to the body by a pylon. Each thruster may be rotatable about an axis of the pylon. The axes of the pylons extend from the body to the respective thruster.

The hull may include an upper aperture disposed in the top of the body and a lower aperture disposed in the bottom of the body. The unmanned underwater vehicle further may also include a vertical thruster disposed in the body between the upper aperture and the lower aperture. The hull may include a second upper aperture disposed in the top of the body and a second lower aperture disposed in the bottom of the body. The unmanned underwater vehicle may further include a second vertical thruster disposed in the body between the second upper aperture and the second lower aperture.

In a further another aspect, the present invention may be characterized, generally, as providing a process for operating an unmanned underwater vehicle, the unmanned underwater vehicle having a hull forming a body with a longitudinal axis of the unmanned underwater vehicle extending between a front and a rear of the body, the longitudinal axis being an X-axis, a Y-axis which extends between opposing sides of the body, and Z-axis which extends between a top and a bottom of the body, the X-, Y-, and Z-axes being orthogonal to each other, a first thruster having an axis of rotation, and a second thruster having an axis of rotation. The process may include: causing the first and second thrusters to rotate about their respective axes of rotation in a first configuration in which the axes of rotation of both the first and second thrusters are parallel with the longitudinal axis of the body; causing the first and second thrusters to rotate about their respective axes of rotation in a second configuration in which the axes of rotation of both the first and second thrusters, when co-planar, intersect; and, sending a signal to cause the first and second thrusters to move from the first configuration to the second configuration or from the second configuration to the first configuration.

The first and second thrusters may be configured to move between the first and second configurations while the unmanned underwater vehicle is deployed underwater.

The signal may be an external signal received by the unmanned underwater vehicle.

The first thruster may be connected to the body by a first pylon, and the second thruster may be connected to the body by a second pylon. The first and second pylons may be moved closer around the Z-axis when the first and second thrusters move from the first configuration to the second configuration. The first and second pylons may be moved farther apart around the Z-axis when the first and second thrusters move from the second configuration to the first configuration. Each pylon may include an axis, and the axes of the pylons extend from the body to the respective thruster. The process may include rotating the first and second thrusters are about the axes of their respective pylon.

These and other aspects and embodiments of the present invention will be appreciated by those of ordinary skill in the art based upon the following description of the drawings and detailed description of the preferred embodiments.

BRIEF DESCRIPTION OF THE DRAWINGS

The attached drawings will make it possible to understand how the invention can be produced and practiced, in which:

FIG. 1 is a top and side perspective view of a UUV according to the present invention with thrusters in a first configuration;

FIG. 2 is a bottom and side perspective view of the UUV shown in FIG. 1 with thrusters in the first configuration;

FIG. 4 is a top and side perspective view of the UUV shown in FIG. 1 with the thrusters in a second configuration;

FIG. 5 is a bottom and side perspective view of the UUV shown in FIG. 1 with thrusters in the second configuration; and, FIG. 6 is a top view of the UUV shown in FIG. 1 with thrusters in the second configuration.

DETAILED DESCRIPTION OF THE PREFERRED EMBODIMENTS

Figure 3:
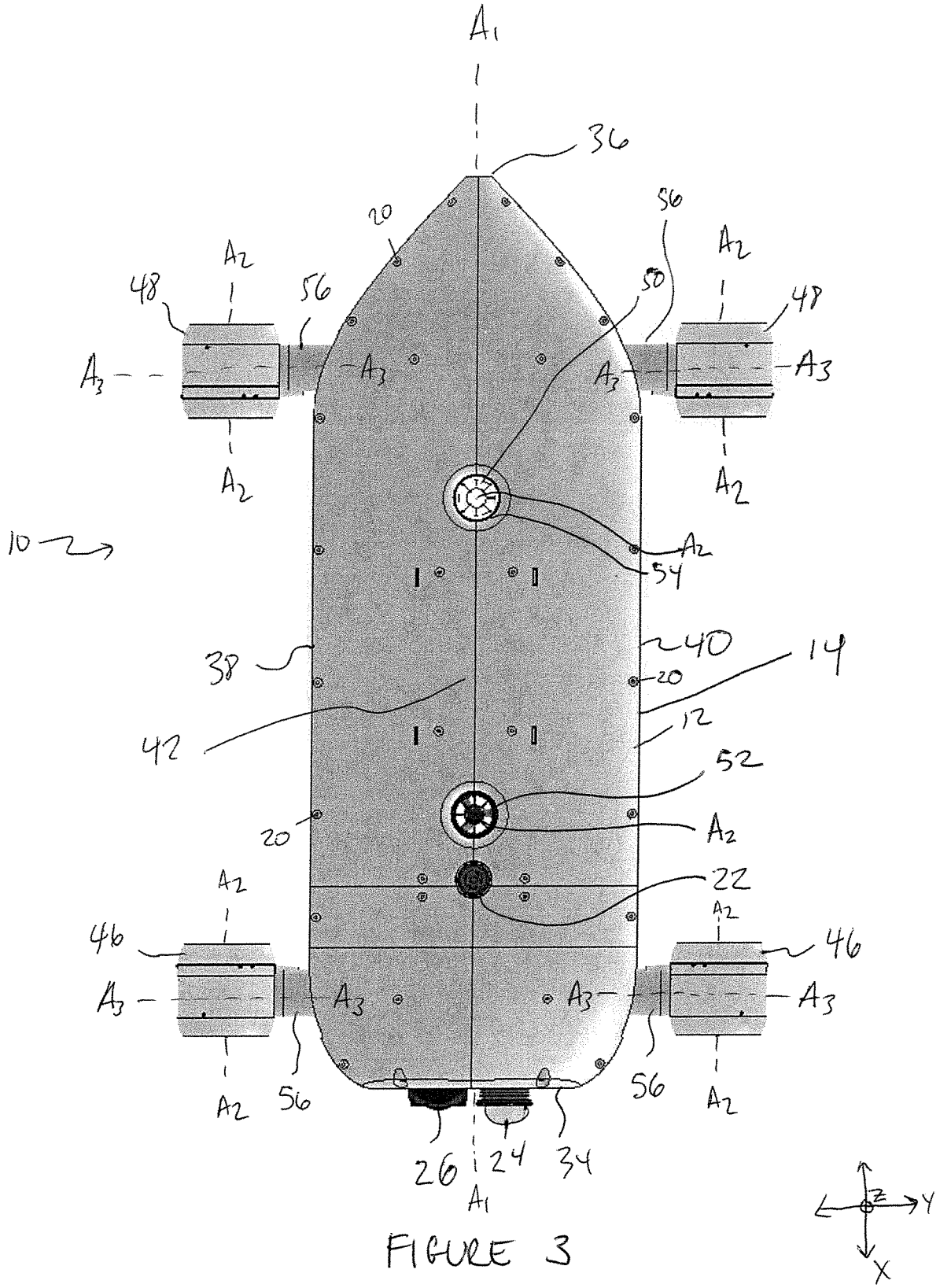
FIG. 3 is a top view of the UUV shown in FIG. 1 with thrusters in the first configuration.

As mentioned above, a new hybrid UUV has been invented. The hybrid UUV utilizes reconfigurable thrusters that are able to move between a first configuration and a second configuration. In the first configuration, the thrusters are configured for long-range movement. In the second configuration, the thrusters are configured for more precise movements. Accordingly, the hybrid UUV is able to efficiently move like an AUV or an ROV depending on the configuration of the thrusters.

Accordingly, with reference the attached drawings, one or more embodiments of the present invention will now be described with the understanding that the described embodiments are merely preferred and are not intended to be limiting.

With reference to the FIGURES, a UUV 10 is depicted. The UUV comprises a body 12 with a hull 14. The hull 14 is preferably constructed out of a plastic or composite material like high-density foam, fiberglass, carbon fiber, aluminum, and/or titanium. The hull 14 may be formed from an upper portion 16 and a lower portion 18 that are held together by a plurality of fasteners 20. Inside of the hull 14 are control electronics (not shown) and power source (not shown), such as a battery.

The control electronics include a controller or a computing device having a processing and a memory which has stored therein computer-executable instructions for implementing the movement of the UUV 10 described herein. The controller or a computing device may be any suitable devices configured to cause a series of steps to be performed so as to implement the various methods or steps such that instructions, when executed by the computing device or other programmable apparatus, may cause various functions/acts/steps described herein to be executed. The controller or a computing device may be, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory may be any suitable known or other machine-readable storage medium. The memory may comprise non-transitory computer readable storage medium such as, for example, but not limited to, an electronic, magnetic, optical, electromagnetic, infrared, or semiconductor system, apparatus, or device, or any suitable combination of the foregoing. The memory may include a suitable combination of any type of computer memory that is located either internally or externally to the device such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. The memory may comprise any storage means (e.g., devices) suitable for retrievably storing the computer-executable instructions executable by the controller or a computing device.

Accordingly, although not depicted, the UUV 10 includes one or more transceivers, transmitters, receivers, ports, connectors, chargers, and other devices that allow for both wired and unwired electrical connection and communication between the UUV 10 and another device.

For example, data can be uploaded from the UUV 10 to another device in communication with the UUV 10. Additionally, data can be downloaded to the UUV 10 from another device in communication with the UUV 10. Similarly, electrical energy can be provided to the UUV 10 to charge batteries on the UUV 10. The electrical connection may be a wired or a wireless connection, such as GSM, CDMA, Wi-Fi, WiMAX, Bluetooth.

As shown in FIG. 1, the UUV 10 is provided with a GPS antenna 22 mounted on a non-moveable support. The UUV 10 may also include a pressure container 24 that may contain a camera (or the like) for obtaining images. For this reason, at least the exposed portions of the pressure container 24 are clear or transparent. As shown in FIG. 2, the UUV 10 may also include an imaging multibeam sonar 26, lights 28, and a doppler velocity log 30. In order to access the internal equipment with the hull 14, the hull 14 may include a removable bottom plate 32 (see, FIG. 2).

In the following description, X is the longitudinal axis A1-A1 of the UUV 10 extending between a front 34 and a rear 36 of the body 12, Y is the transverse axis which extends between opposing sides 38, 40 of the body 12, and Z is the vertical axis which extends between a top 42 and a bottom 44 of the body 12, with these three directions X, Y, and Z being orthogonal to each other.

The present UUV 10 further includes a propulsion system which includes a plurality of thrusters 46, 48, 50. As is known, each thruster 46, 48, 50 includes a propeller 52 (or other rotatable structures) (see FIG. 3) that is rotated about an axis A2-A2 by a motor (not shown).

The plurality of thrusters may include at least one vertical thruster 50 located within the body 12 of the UUV 10. Specifically, apertures 54 in the hull 14, on the top 42 and bottom 44 of the body 12, may be be provided. The vertical thruster 50 is located between the apertures 54. The axis A2-A2 of the vertical thruster 50 may be parallel with the Z-axis. Accordingly, the vertical thruster 50 may be used for moving the UUV 10 primarily in the Z direction.

The plurality of thrusters also includes at least two forward thrusters 46, 48. Depending on the direction of rotation, the thruster 46, 48 will either provide movement forward along the X-axis or backward along the X-axis. As should be appreciated, the use of "forward" is not intended to be limiting but instead to denote that that these thrusters 46, 48 are configured to move the UUV 10 along the X-axis (i.e., forward and backward) as well as rotate the UUV 10 around the Z-axis (i.e., turn the UUV 10). Accordingly, the axis A2-A2 of the forward thrusters 46, 48 extends in the XY plane.

In the depicted UUV 10, four forward thrusters 46, 48 are provided. A first set of forward thrusters 46 is positioned proximate the front 34 of the body 12, one on each of the opposing sides 38, 40, at the same general location along the X-axis. A second set of forward thrusters is 48 positioned proximate the rear 36 of the body 12, one on each of the opposing sides 38, 40, at the same general location along the X-axis. By "proximate the front of the body" it is meant that these thrusters 46 are located closer to the front 34 than to the rear 36, and conversely, by "proximate the rear of the body," it is meant that these thrusters 48 are located closer to the rear 36 than to the front 34.

Figure 6:
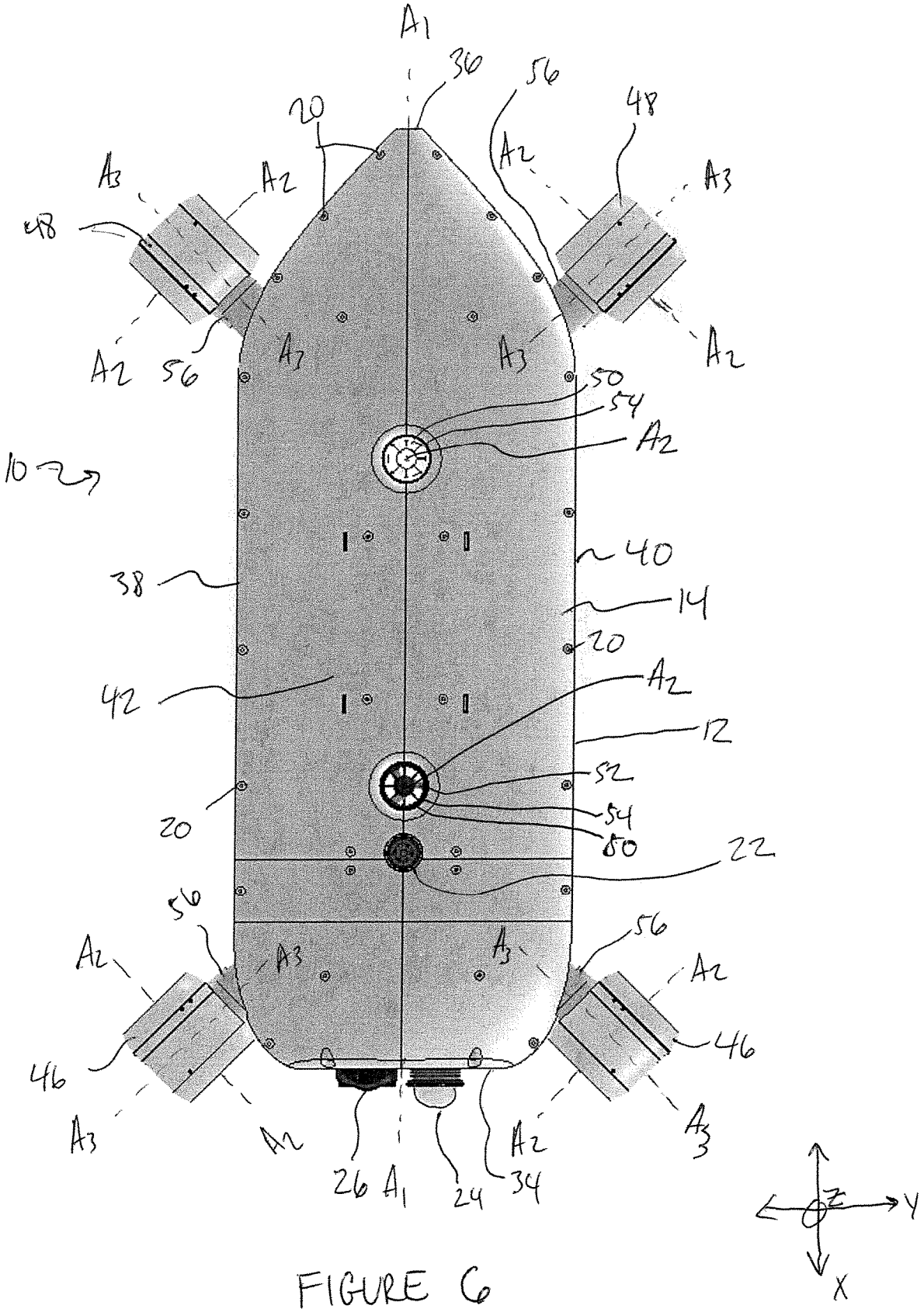

According to the present invention, the forward thrusters 46, 48 may be selectively moved, or reconfigured, between a first configuration (FIGS. 1 to 3) and a second configuration (FIGS. 4 to 6).

In the first configuration (FIGS. 1 to 3), the axes A2-A2 of the forward thrusters 46, 48 are generally parallel with the X-axis. In other words, in the first configuration, the axes A2-A2 of the forward thrusters 46, 48 are parallel with each other, as well as with the longitudinal axis A1-A1 of the UUV 10. The first configuration resembles a move conventional UUV configuration in which the UUV 10 is configured for efficient long-range movement.

However, if it is desired that the UUV 10 utilize more precise movement, the forward thrusters 46, 48 may be positioned in the second configuration (FIGS. 4 to 6). In the second configuration, the axes A2-A2 of the forward thrusters 46, 48 are aligned to intersect with the X-axis. In other words, in the second configuration, the axes A2-A2 of the forward thrusters 46, 48 from each set (forward or rear) are aligned to intersect with each other, as well as with the longitudinal axis A1-A1 of the UUV 10. Therefore, compared with the first configuration, in the second configuration, the forward thrusters 46, 48 of a set are closer to each other, based on a distance measured along an arc connecting the axes A2-A2 and passing through the X-axis.

If provided with multiple sets of thrusters 46, 48, it is contemplated that less than all of the sets may be changed. In other words, one or more sets may be positioned in the first configuration, and, at the same time, one or more sets may be positioned in the second configuration. For example, it is contemplated that only the front set of forward thrusters 46 are changed from a first configuration to a second configuration. Thus, the second, or rear, set of forward thrusters 48 may remain in the first configuration.

The positions of the forward thrusters 46, 48 may be changed by moving pylons 56 which connect the thrusters 46, 48 to the body 12. Each forward thrusters 46, 48 is associated with a pylon 56 that has a longitudinal axis A3-A3 extending from the respective thruster 46, 48 to the body 12. When viewed from the top or bottom, in the second configuration (FIG. 6), the pylons 56 of the forward thrusters 46, 48 in a set have been moved closer around the Z-axis (running in and out of the paper) when compared with the first configuration (FIG. 3).

In addition to the forward thrusters 46, 48 being movable, it is contemplated that the forward thrusters 46, 48 may rotate about their respective pylons 56 to allow for more precise control in directions having a Z-direction component. More specifically, the UUV 10 may be provided with the ability for each of the forward thrusters 46, 48 to be rotated. It should be appreciated that in configurations in which the forward thrusters 46, 48 are rotatable about the axes A3-A3 of the pylons 56, the discussion regarding axes A2-A2 of the forward thrusters 46, 48 being parallel, or non-parallel, refers to when the axes A2-A2 of the forward thrusters 46, 48 are in the same plane, or are co-planar.

For example, as shown in FIG. 6 in the second configuration, the axes A2-A2 for the two front forward thrusters 46 interest when both axes A2-A2 are in the same plane (XY plane). However, if one or both of the two front forward thrusters 46 are rotated about the axis A3-A3 of its pylon 56, the axes A2-A2 of the two front forward thrusters 46 will not be in the same plane, but instead may be be skew lines and which do not intersect and are not parallel. But, if returned to the same plane, the axes A2-A2 of the two front forward thrusters 46, in the second configuration, will intersect.

The present UUV 10 provides the ability to operate the UUV 10 in both a long-range operation mode, on one hand, and an operation mode that demands more precise movements, on the other hand. It should be appreciated that this provides the ability to change between the operation modes while the UUV 10 is deployed underwater.

When the UUV 10 is deployed, the propellers 52 of the forward thrusters 46, 48 may be rotated about their respective axes A2-A2 which will cause the UUV 10 to move through the water. With respect to the configuration when the UUV 10 is initially deployed, the forward thrusters 46, 48 may be either in the first configuration or the second configuration. At some point after being deployed, the UUV 10 may change the configuration of the forward thrusters 46, 48.

For example, the UUV 10 may receive an external signal which causes the controller to cause some or all of the forward thrusters 46, 48 to move, for example, from the first configuration to the second configuration. Alternatively, the UUV 10 may receive an external signal which causes the controller to cause some or all of the forward thrusters 46, 48 to move from the second configuration to the first configuration. In other words, the UUV 10 may be responding to signals sent from an external source, like a computer in communication with a remote control, like a joystick, that is being operated by a person.

Alternatively, the UUV 10 may receive an internal signal which causes the controller to cause some or all of the forward thrusters 46, 48 to move from the first configuration to the second configuration or from the second confirmation to the first configuration. For example, the UUV 10 may be specifically programmed or include software that specifies the desired or planned movement of the unmanned underwater vehicle.

In the broadest aspects, the present processes do not necessarily require the first configuration to be used before the second configuration. Thus, the process may include causing the some or all of the forward thrusters 46, 48 to move from the first configuration to the second configuration or from the second configuration to the first configuration. The movement may be responsive to a signal that is sent.

As noted above, the signal may originate internally, i.e., be part of a software program. For example, the movement could be pre-programmed to occur at a specific location, at a specific depth, at a specific time, after a specific amount of time. Alternatively, this signal may originate externally relative to the UUV 10. Examples of what cause an external signal to be sent to move the forward thruster 46, 48 include a specific location, at a specific depth, at a specific time, after a specific amount of time. Additionally, the external signal source could be the result of a remote human operator's action to cause the movement on the joystick of other control device.

If the forward thrusters 46, 48 have the ability to rotate about the axis A3-A3 of the pylons 56, the present processes may also include rotating one or more of the forward thrusters 46, 48 around the axis A3-A3 of its respective pylon 56. Again, this rotation may be a result of an internal or external signal that may be generated as discussed above.

The methods and steps described herein may be implemented in a high-level procedural or object-oriented programming or scripting language, or a combination thereof, to communicate with or assist in the operation of the controller or computing device. Alternatively, the methods and systems described herein may be implemented in assembly or machine language. The language may be a compiled or interpreted language. Program code for implementing the methods of changing the configuration of the thrusters described herein may be stored on the storage media or the device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein.

Computer-executable instructions may be in many forms, including program modules, executed by one or more computers or other devices. Generally, program modules include routines, programs, objects, components, data structures, etc., that perform particular tasks or implement particular abstract data types. Typically, the functionality of the program modules may be combined or distributed as desired in various embodiments.

By providing the ability to operate in two configurations, the present UUV 10 can be used both in situations where long-range operation mode is preferred and in situations where a more precise operation mode is needed. Further, such an ability allows the UUV 10 to transition back and forth as needed for efficient operation. This allows for more efficient use of energy which, in turn, may prolong the ability of the UUV 10 to be deployed.

As is apparent from the foregoing specification, the invention is susceptible of being embodied with various alterations and modifications which may differ particularly from those that have been described in the preceding specification and description. It should be understood the scope of the patent warranted hereon includes any and all such modifications as reasonably and properly come within the scope of the contribution to the art.

The invention claimed is:

1. An unmanned underwater vehicle comprising:

a hull forming a body with a longitudinal axis of the unmanned underwater vehicle extending between a front and a rear of the body, the longitudinal axis being an X-axis, a Y-axis which extends between opposing sides of the body, and Z-axis which extends between a top and a bottom of the body, the X-, Y-, and Z-axes being orthogonal to each other;

a first thruster having an axis of rotation;

a second thruster having an axis of rotation, wherein the first and second thrusters have a first configuration, in which the axes of rotation of both the first and second thrusters are parallel with the longitudinal axis of the body, and a second configuration, in which the axes of rotation of both the first and second thrusters, when co-planar with each other and the longitudinal axis of the body, intersect;

an aperture extended between the top and the bottom of the body; and a vertical thruster disposed within the aperture.

2. The unmanned underwater vehicle of claim 1, wherein the first and second thrusters form a set of thrusters having the same position, on opposing sides, along a length of the body.

3. The unmanned underwater vehicle of claim 2, further comprising:

a third thruster having an axis of rotation; and, a fourth thruster having an axis of rotation, wherein the third and fourth thrusters are selectively movable between the first configuration, in which the axes of rotation of both the third and fourth thrusters are parallel with the longitudinal axis of the body, and the second configuration, in which the axes of rotation of both the third and fourth thrusters, when co-planar, intersect.

4. The unmanned underwater vehicle of claim 3, wherein the third and fourth thrusters form a second set of thrusters having the same position, on opposing sides, along a length of the body.

5. The unmanned underwater vehicle of claim 3, wherein in the first configuration the axes of the first and third thrusters are parallel, and the axes of the second and fourth thrusters are parallel.

6. The unmanned underwater vehicle of claim 5, wherein in the second configuration the axes of the first and fourth thrusters are, when co-planar, parallel, and the axes of the second and third thrusters are, when co-planar, parallel.

7. The unmanned underwater vehicle of claim 1, further comprising:

a vertical thruster having an axis of rotation parallel with the Z-axis.

8. The unmanned underwater vehicle of claim 1, wherein each thruster is connected to the body by a pylon.

9. The unmanned underwater vehicle of claim 8, wherein each thruster is rotatable about an axis of the pylon, the axes of the pylons extending from the body to the respective thruster.

10. An unmanned underwater vehicle comprising:

a hull forming a body with a front, a rear, a first side, a second side opposite the first side, a top, and a bottom;

a first set of thrusters positioned proximate the front of the body, the first set of thrusters including a first thruster disposed on the first side and a second thruster disposed on the second side; and, a second set of thrusters positioned proximate the rear of the body, the second set of thrusters including a third thruster disposed on the first side and a fourth thruster disposed on the second side, wherein each thruster has an axis of rotation, and, wherein the first set of thrusters has a first configuration, in which the axes of rotation of both the first and third thrusters, when co-planar, are parallel and the axes of rotation of both the second and fourth thrusters are parallel, and further has a second configuration, in which the axes of rotation of both the first and second thrusters, when co-planar with each other and the longitudinal axis of the body, interest, and wherein the hull comprises an upper aperture disposed in the top of the body and a lower aperture disposed in the bottom of the body, and the unmanned underwater vehicle further comprising:

a vertical thruster disposed in the body between the upper aperture and the lower aperture.

11. The unmanned underwater vehicle of claim 10, wherein each thruster is connected to the body by a pylon.

12. The unmanned underwater vehicle of claim 11, wherein each thruster is rotatable about an axis of the pylon, the axes of the pylons extending from the body to the respective thruster.

13. The unmanned underwater vehicle of claim 10, wherein the hull comprises a second upper aperture disposed in the top of the body and a second lower aperture disposed in the bottom of the body, and the unmanned underwater vehicle further comprising:

a second vertical thruster disposed in the body between the second upper aperture and the second lower aperture.

14. A process for operating an unmanned underwater vehicle, the unmanned underwater vehicle having a hull forming a body with a longitudinal axis of the unmanned underwater vehicle extending between a front and a rear of the body, the longitudinal axis being an X-axis, a Y-axis which extends between opposing sides of the body, and Z-axis which extends between a top and a bottom of the body, the X-, Y-, and Z-axes being orthogonal to each other, a first thruster having an axis of rotation, and a second thruster having an axis of rotation, the process comprising:

causing the first and second thrusters to rotate about their respective axes of rotation in a first configuration in which the axes of rotation of both the first and second thrusters are parallel with the longitudinal axis of the body;

causing the first and second thrusters to rotate about their respective axes of rotation in a second configuration in which the axes of rotation of both the first and second thrusters, when co-planar, intersect; and, sending a signal to cause the first and second thrusters to move from the first configuration to the second configuration or from the second configuration to the first configuration, wherein the first and second thrusters move between the first and second configurations while the unmanned underwater vehicle is deployed underwater, wherein the first thruster is connected to the body by a first pylon, and wherein the second thruster is connected to the body by a second pylon, wherein the first and second pylons are moved closer around the Z-axis when the first and second thrusters move from the first configuration to the second configuration, and wherein the first and second pylons are moved farther apart around the Z-axis when the first and second thrusters move from the second configuration to the first configuration.

15. The process of claim 13, wherein the signal is an external signal received by the unmanned underwater vehicle.

16. The process of claim 13, wherein each pylon comprises an axis, and wherein the axes of the pylons extend from the body to the respective thruster, and the process further comprising:

rotating the first and second thrusters are about the axes of their respective pylon.

* * * * *